US005123207A

United States Patent [19]

Gillis, Jr. et al.

[11] Patent Number: 5,123,207

[45] Date of Patent: Jun. 23, 1992

[54] MOBILE $CO_2$ BLASTING DECONTAMINATION SYSTEM

[75] Inventors: Patrick J. Gillis, Jr., Stoughton; Benjamin Sklar, Plymouth; Andrew J. Kral, Walpole; Marshall C. Randolph, Wellesley, all of Mass.

[73] Assignee: TTI Engineering Inc., Walpole, Mass.

[21] Appl. No.: 605,959

[22] Filed: Oct. 30, 1990

[51] Int. Cl.[5] ..... B24C 3/06

[52] U.S. Cl. ..... 51/426; 51/427; 51/273

[58] Field of Search ..... 51/426, 427, 428, 429, 51/317, 319, 321, 322, 273

[56] References Cited

U.S. PATENT DOCUMENTS

| | | | |
|---|---|---|---|
| 3,103,765 | 9/1963 | Nolan | 51/427 |
| 3,670,516 | 6/1972 | Duron et al. | 62/35 |
| 4,038,786 | 8/1977 | Fong | 51/320 |
| 4,389,820 | 6/1983 | Fong et al. | 51/320 |
| 4,800,063 | 1/1989 | Mierswa | 51/425 |
| 4,866,227 | 9/1989 | Johnson et al. | 250/385.1 |
| 4,993,199 | 2/1991 | Hughes | 51/273 |

*Primary Examiner*—Bruce M. Kisliuk
*Assistant Examiner*—Eileen P. Morgan
*Attorney, Agent, or Firm*—Cesari and McKenna

[57] ABSTRACT

A mobile decontamination system comprises a pair of strong weathertight transportable sea containers which can be positioned side-by-side at a jobsite. One of the containers is partitioned to divide the container into separate compartments including a decontamination room, a decontamination cell room and a count room, there being normally closed doorways between the compartments. Large or heavy objects are cleaned in the decontamination room, preferably using $CO_2$ pellets delivered under high pressure through a discharge hose. Smaller objects are cleaned in a special decontamination cell or glovebox located in the decontamination cell room. For this, $CO_2$ pellets are delivered under high pressure through a hose to the decontamination cell. After objects are cleaned in the cell, they may be tested by monitors in the count room to verify that the objects are indeed clean. The second container houses the heavy equipment required to service the first container.

19 Claims, 2 Drawing Sheets

MOBILE $CO_2$ BLASTING DECONTAMINATION SYSTEM

This invention relates to non-destructive cleaning and decontamination. It relates more particularly to a mobile cleaning and decontamination system preferably utilizing $CO_2$ blasting.

BACKGROUND OF THE INVENTION

As part of a routine maintenance program, it is often necessary to clean and/or decontaminate tools and pieces of equipment which have become "dirty" by virtue of their everyday use in a contaminated environment. For example, in a nuclear power plant or other reactor facility, tools, utensils and machine parts may come in contact with radioactive liquids, dust, aerosols, and the like which may adhere to their surfaces so that after a period of time, they may become sufficiently contaminated to present a radiation hazard. To avoid this problem, these items would be cleaned periodically so that the radiation which they emit is maintained below an acceptable level or count. The same problem arises with biologically and chemically contaminated parts.

Various techniques have been used to clean the surfaces of contaminated objects. These include blasting the object surfaces with water or grit and cleaning the surfaces with freon or other chemicals. These prior techniques are disadvantaged because they create a secondary waste problem because the dirt and contamination on the object being cleaned becomes entrained in the cleaning medium which then has to be disposed of as secondary waste.

There does exist a dry process which cleans and decontaminates by blasting the object to be cleaned with particles capable of sublimation, for example, carbon dioxide ($CO_2$) particles. This process, described, for example, in U.S. Pat. Nos. 4,038,786 and 4,389,820, uses solid carbon dioxide particles or pellets propelled by dry compressed air. The $CO_2$ particles shatter upon impact with the surface to be cleaned and flash into dry $CO_2$ gas which penetrates the surface pores and flushes out any dirt or contamination therein. The $CO_2$ particles do not abrade or attack the surface of the object being cleaned. Consequently, the process can be used to clean hard objects made of metal or the like, as well as softer objects made of rubber, wood, plastic, etc. Advantageously also, since the process relies on a material which sublimates or gasifies while cleaning, there is no accumulation of contaminated particulate matter or chemicals that would require disposal as hazardous waste.

It has been proposed to use the $CO_2$ blasting process to satisfy the parts cleaning and decontamination procedures that have to be carried out routinely in this country's nuclear power plants and similar facilities. However, attempts to adapt or accommodate such a system to these standard procedures have not proven to be too successful because of the cost involved. More particularly, the standard decontamination routine at this country's nuclear facilities requires the establishment of closed rooms for the treatment of tools and equipment which present different degrees of danger to the decontamination team and to others. For example, in a simple case, the facility may include one room for cleaning or decontaminating relatively large parts which have a high overall radiation count. The personnel working in that room and cleaning those parts may have to be completely enclosed in protective clothing with self-contained breathing equipment. A second room of the decontamination facility may be devoted to cleaning small parts and tools that present a lesser radioactive hazard. The contaminated parts may be brought into the second room with the actual cleaning of the parts being carried out in a sealed decontamination cell or glovebox in the second room so that the personnel working in that room do not have to wear protective clothing other than, say, a lab coat.

Other areas of the facility may be dedicated to cleaning other categories of equipment. Invariably also, each facility includes a so-called clean or count room where the decontaminated parts may be checked or "frisked" with a radiation counter to verify that they are indeed clean before the parts are returned to service. Personnel in this area are normally exposed to minimal radiation and may, therefore, wear street clothes. Not only must certain safety procedures be carried out in each different room of the contamination facility, but also strict routines must be followed when moving from room to room to insure that contaminants in one room are not transported into a cleaner room. For the same reason, the facility's ventilation system must be designed to prevent contaminants from being entrained in the air circulating between rooms.

Also, if decontamination is to be conducted using the aforesaid $CO_2$ pellet blasting system, there must be an additional relatively large room in the facility devoted to the pellet making machine and the equipment required to produce the dry air stream to propel those pellets against the objects to be cleaned.

The net result is that a permanent decontamination facility that cleans by $CO_2$ blasting which is only used on a periodic basis, e.g. every six months, is very expensive to maintain. First, it occupies a relatively large amount of ground space which is usually at a premium at most reactor facilities. Also, the building itself is invariably quite costly because its various rooms, particularly the ones used for decontamination, require, in accordance with accepted practice, walls faced with stainless steel panels which can be cleaned easily and with special seams between the panels to prevent leakage from the rooms of airborne radioactive material. Finally, the apparatus for making and propelling the $CO_2$ pellets is relatively expensive so that it is not cost effective to leave the apparatus on-site and use it only every six months or so.

Resultantly, at those reactor facilities where $CO_2$ blasting decontamination is performed, it has been the practice to transport the pellet-making apparatus and ancillary equipment to the jobsite when decontamination is due, erect a completely new decontamination facility, carry out the decontamination program and then tear down the building and transport everything from the site. Invariably, those portions of the building, i.e. walls, ceiling panels, etc., exposed to radiation, are considered hazardous waste and have to be disposed of accordingly. Obviously, decontamination on this "hit and run" basis is also very costly both in terms of manpower and materials. Moreover, even though the decontamination process by $CO_2$ blasting does not create radioactive waste directly, the destruction of the decontamination facility upon completion of the job does, as just stated, result in secondary waste.

It has also been found that conventional $CO_2$ blasting systems are not particularly adapted to clean or decontaminate parts in an isolated environment, i.e. inside a decontamination cell or glovebox. This is because it is difficult if not impossible to aim the apparatus' discharge nozzle with sufficient accuracy to enable the $CO_2$ pellets issuing from the nozzle to properly scrub all areas of the part being processed. Resultantly, the decontamination of small and intricate parts using standard $CO_2$ cleaning equipment tends to be tedious and time-consuming.

SUMMARY OF THE INVENTION

Accordingly, it is an object of the present invention to provide an improved decontamination system of the $CO_2$ blasting type.

Another object of the invention is to provide a system such as this which is completely mobile so that it can be transported to and from the jobsite at which the decontamination process is performed.

Yet another object of the invention is to provide a mobile decontamination system or facility which has a relatively long useful life.

Still another object of the invention is to provide a system or facility such as this which requires a minimum amount of time and effort to make it operational after it is brought to a particular jobsite.

A further object of the invention is to provide a mobile cleaning or decontamination facility which can be transported to and from reactor sites on today's system of roads and highways without requiring any special permits for an oversized load.

A further object of the invention is to provide a facility that can be transported over the road as a stsrong tight container under DOT rules and regulations after it has become a radioactively contaminated.

A further object of the invention is to provide a system or facility of this general type which utilizes improved $CO_2$ blasting apparatus which can clean and decontaminate parts having a variety of different shapes.

Another object of the invention is to provide a $CO_2$ blasting decontamination cell which facilitates the cleaning and decontamination of intricate parts.

Other objects will, in part, be obvious and will, in part, appear hereinafter. The invention accordingly comprises the features of construction, combination of elements and arrangement of parts which will be exemplified in the following detailed description, and the scope of the invention will be indicated in the claims.

Briefly, our decontamination system or facility comprises a pair of relatively large structural enclosures, which are preferably so-called sea containers. These are the strong, weather-tight, structural steel containers that are often used to transport goods by truck, rail and ship. They are especially rugged and resistant to racking because each has a built-in system of reinforcing beams in its walls as well as a very sturdy floor. Moreover, each container can fit on a conventional flatbed truck or trailer and be transported to and from a jobsite, e.g. a reactor facility, on the nation's highways without the special permits that are sometimes required for oversized loads.

The first container is divided lengthwise into a plurality of compartments or rooms, there being one compartment for cleaning and decontaminating relatively large objects denominated a decontamination room, a second compartment, called the decontamination cell room, for cleaning and decontaminating smaller objects as well as parts and tools, and a third compartment, the so-called count room, in which the objects are tested to verify that they are free of contamination.

The decontamination room is exposed to the most contamination. Accordingly, its walls are lined with stainless steel panels with sealed seams between the panels to facilite cleaning the walls and to prevent radioactive dust and aerosols from escaping from the first compartment. Also, the floor and ceiling of that first compartment are faced with materials that are likewise easily cleaned and approved for such facilities. Preferably, that first compartment is provided with an overhead traveling hoist to facilitate moving large and heavy parts Within that compartment.

The second or middle compartment in the first container contains a decontamination cell or glovebox in which smaller parts and tools may be decontaminated. There are controlled accesses between the second compartment and the outside and between the first and second compartments s that following accepted practices, contaminated objects can be delivered to the outside door of the second compartment. The large or heavy parts are transported into the first compartment where a person wearing special protective clothing and breathing equipment cleans and decontaminates those parts, preferably using a more or less standard carbon dioxide blasting apparatus. The smaller objects are placed on a table adjacent to the decontamination cell in the second compartment by a properly clad worker in that compartment. Those objects are eventually inserted into the decontamination cell and cleaned, preferably by $CO_2$ blasting utilizing a special $CO_2$ pellet discharge nozzle to be described later. The small cleaned objects are then removed from the cell and placed on a table in the second compartment until they are ready to be conveyed to the third compartment in the first container, which is the count room. In the count room, a worker "frisks" those parts with a standard radiation counter to verify that they are indeed clean and free of contamination.

The third compartment, which also has a doorway into the second compartment, is the cleanest of the three and the personnel therein may not be required to wear any special clothing.

Thus, in our facility, all of the decontamination and testing procedures are carried out in the first container.

The second sea container contains most of the heavy equipment required to service the first container. It is transported to the decontamination site on a flatbed truck or trailer and stationed next to the first container so that the two containers are close together, side-by-side. The second container has an access opening in its side wall which mates with a doorway in the side wall of the first container within the count room thereof. Since both the count room in the first container and the second container are not exposed to contaminated parts, there is no need to take special precautions when moving between those two spaces. The large double doors invariably present at an end of the usual sea container enable heavy machinery and equipment to be placed in and taken from that container. That heavy equipment includes a $CO_2$ pellet-making machine and an air dryer for drying the air used to propel those pellets against the articles being decontaminated in the first container. The second container also houses the heating, ventilation and air conditioning (HVAC) equipment required to provide a pleasant environment for the personnel working in the decontamination facility. The two containers have the requisite ducting and vents which connect through releasable couplings at the adjacent sides of the containers to provide an air circulation loop with the proper pressure differentials and filtering to ensure that there is no escape of contaminated airborne dust or aerosols from the first compartment and the decontamination cell in the first container.

Although the could also be placed in the second container, preferably, the air compressor and $CO_2$ tank, required to operate the pellet-making machine, are conveyed to the jobsite on a third trailer which is positioned right next to the remaining side wall of the second container. Hoses leading from the air compressor and tank may be coupled to conventional quick-disconnect type fittings mounted in the side wall of the second container. Those fittings are connected by appropriate pipes to the inlets of the air dryer and pellet-making machine. The outlets of the dryer and pellet-maker are connected via appropriate pipes or hoses to discharge nozzles in the first compartment of the first container and in the decontamination cell in the second compartment of that container to enable the decontamination personnel to clean both large and small parts and other objects.

BRIEF DESCRIPTION ON OF THE DRAWINGS

For a fuller understanding of the nature and objects of the invention, reference should be had to the following detailed description, taken in connection with the accompanying drawings, in which:

FIG. 1 is a horizontal sectional view showing a decontamination system or facility incorporating our invention, and FIG. 2 is an isometric view on a much larger scale and with parts cut away showing certain elements of the FIG. 1 system or facility in greater detail.

DESCRIPTION OF THE PREFERRED EMBODIMENT

Figure 1:
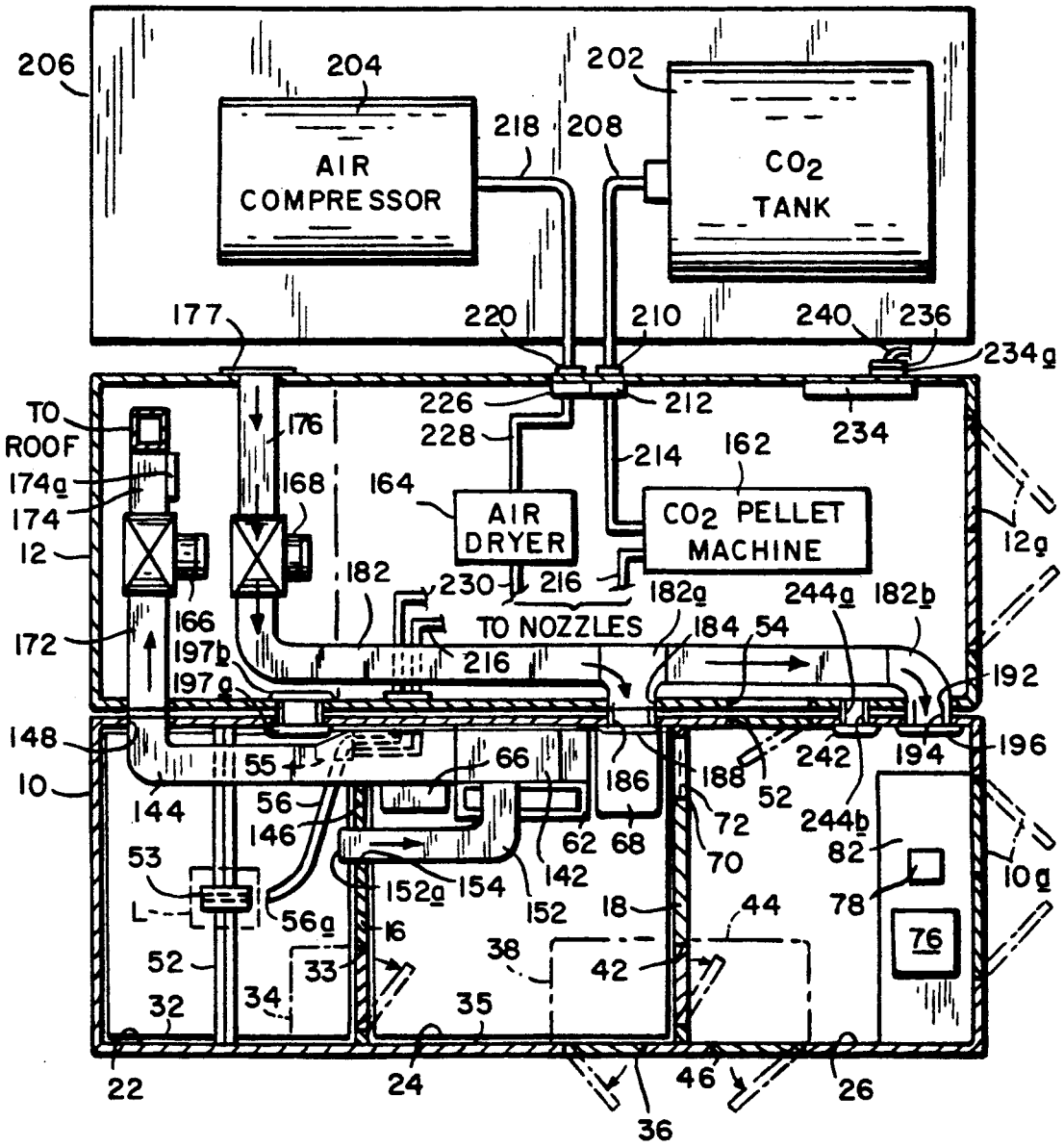

Referring to FIG. 1 of the drawings, our decontamination system comprises a pair of relatively large, self-supporting containers 10 and 12 which are rugged enough to be capable of being moved around and handled relatively roughly. The preferred container is of the type currently used to transport goods on container ships. These so-called sea containers are very sturdy and weathertight and they are formed with sturdy floors and integral beams in their various walls which make the containers 10 and 12 very transportable and long lived. Typically, each container 10,12 is in the order of 20 ft. long, 8 ft. wide and 8 ft. high and is provided with large double doors **10*a*,12*a* in an end wall so that large pieces of machinery can be brought into the container quite easily. Each container 10,12 fits on a standard flatbed truck or trailer so that it can be transported over the road to and from a jobsite quite easily and without requiring any special variance from the customary highway load limits. In use, the two containers are positioned side-by-side as shown in FIG. 1** either on their trailers or on the ground.

As shown in FIG. 1, a pair of transverse walls or partitions 16 and 18 divide the container 10 lengthwise into three compartments 22, 24 and 26. Compartment 22, located at the closed end of the container 10 and having an area of about 6×8 feet, constitutes a decontamination room where the decontamination of the larger parts is carried out. Since this compartment is likely to contain a relatively large amount of contaminated airborne particulate matter, it is important that means be taken to prevent the escape of such particles from that space. To this end, and to facilitate cleaning compartment 22, the walls of that compartment are lined with stainless steel panels 32 connected together along overlapping sealed seams. Also, the floor and ceiling of that space are faced with stainless steel panels.

Access is had into compartment 22 through a doorway 33 in partition 16 which opens into compartment 24. In order to pass through doorway 32, a certain safety procedure or routine, e.g. washing, change of clothing, etc., is followed as indicated by the phantom rectangle 34 in FIG. 1.

Smaller parts and objects are cleaned in compartment 24 which has an area of about 7×8 feet. The walls of this compartment are also provided with a stainless steel lining 35. Access into the center compartment 24 from the outside is through a doorway 36. When passing through that doorway, another safety routine must be followed as indicated by the phantom rectangle 38 there.

Compartment 26, which is about 5×8 feet, is a so-called count room where the parts cleaned in compartment 24 may be tested or frisked to verify that they are free of contamination. Since that room is "clean", its walls need not be lined with stainless steel panels. Communication between compartments 24 and 26 is through a doorway 42 in partition 18. Again, when passing through that doorway, a routine is followed as indicated by the phantom rectangle 44 at that location. Compartment 26 also has its own doorway 46 to the outside and a second doorway 52 in the wall of that compartment opposite doorway 46 which registers with an opening 54 in the side wall of container 12 when the two containers are side-by-side as in FIG. 1. Thus, personnel are able to walk back and forth between compartment 26 and the interior of container 12.

As mentioned previously, the decontamination of relatively large objects in carried out in compartment 22. Accordingly, to facilitate moving those objects, that compartment is provided with an overhead beam or track 53 which supports a travelling hoist 54 capable of picking up a relatively large or heavy e.g. one ton, object and transporting it between a location adjacent to doorway 33 and a location L at which the object can be cleaned and decontaminated. Preferably, decontamination is carried out using a $CO_2$ blasting process. Carbon dioxide pellets are delivered into compartment 22 through nozzle 55 to a flexible hose 56. By manipulating the end **56*a* of the hose, $CO_2$ pellets can be directed against all of the exterior surfaces of an object brought to location L by hoist 53** or by a standard lift cart.

Figure 2:
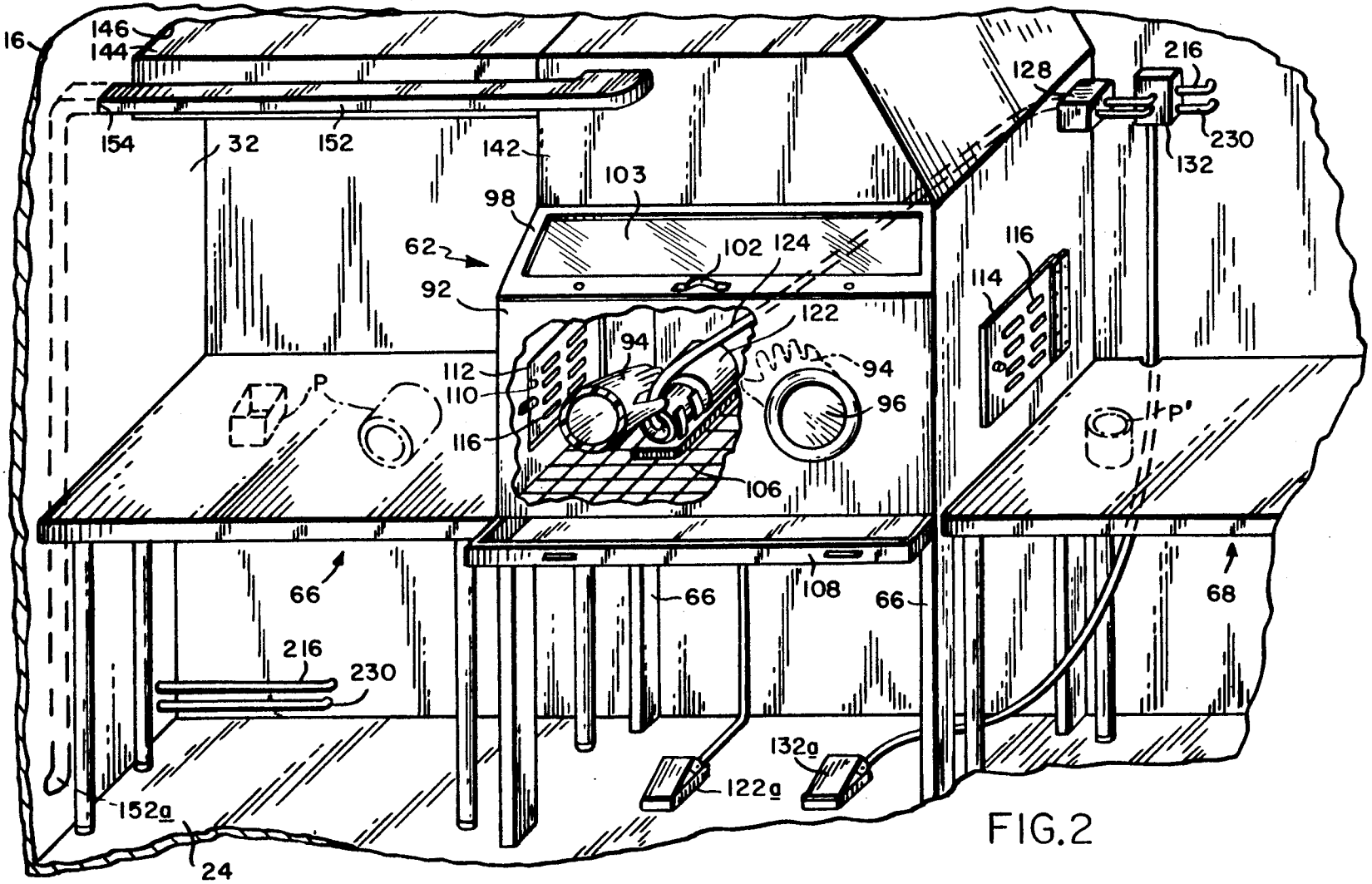

Smaller objects such as tools and fittings are cleaned in a decontamination cell or glovebox 62 located in compartment 24. As shown in FIG. 2, cell 62 is supported on legs 64 between a pair of removable stainless steel tables 66 and 68 at the rear of compartment 24. The small parts that ar to be decontaminated in cell 62 are placed on table 66 to the left of cell 62 as shown in phantom at P in FIG. 2. After being decontaminated in the cell 62, the clean parts are placed on table 68 to the right of the cell as shown at P'.

The righthand compartment 26, the count room, is the cleanest of the three compartments. As shown in FIG. 1, a window 70 fitted with a slider 72 is provided in partition 18 just above table 68 in compartment 24. Thus, a worker in compartment 26 can open slider 72 and lift the decontaminated parts P' on table 68 into compartment 26 where they can be tested to verify that they are free of decontamination. For that purpose, a standard radiation counter 76 and frisker 78 are provided on a table 82 inside compartment 26. The customary smearing and smear counting of parts P' may also be done on this table.

Refer now to FIG. 2 which shows the decontamination cell 62 in greater detail. The cell comprises a generally rectangular stainless steel housing 92. Mounted to the front wall of housing 92 inside the housing are a pair of heavy rubber gloves 94. Access to the interior of each glove is had through an opening 96 in the housing front wall. The upper portion of the housing front wall is formed as a swing-up door 98. The door 98 can be lifted by a handle 102 to gain access to the interior of housing 92. Preferably also, door 98 is provided with a transparent glass or plastic window 93 so that the person using the cell can see inside the housing. The bottom wall of housing 92 is constituted by a stainless steel grating 106. Suspended under grating 106 is a pull-out tray 108 which collects particles and debris produced by the decontamination process carried out in cell 62 that will be described presently.

The parts P to be decontaminated are inserted into cell 62 through an opening 110 in the lefthand wall of housing 92, just above table 66. That opening is normally closed by a door 112. After cleaning, the parts P are removed from the cell through a similar opening in the righthand wall of housing 92 which is normally closed by a door 114. Both of the doors 112 and 114 are provided with a multiplicity of small louvres or vent openings 116 for reasons that will become apparent.

Preferably a motorized vise 122 is located in housing 92 to enable a part P to be firmly gripped while being cleaned or decontaminated. Vise 122 may be controlled by a foot pedal switch **122*a* located on the floor underneath cell 62. Once a part P has been placed inside the cell, an operator may pick up that part using gloves 94 and position it in the vise 122 which may then be tightened using foot pedal switch 122*a*. There may also be a rack (not shown) in cell 62** for supporting the parts P for cleaning.

Decontamination of the parts in cell 62 is carried out by directing carbon dioxide pellets against the surfaces of the parts. Those pellets may be delivered to the cell through a flexible hose 124 whose free end is manipulated by the operator's hand in a glove 94. Hose 124 leads from a pellet discharge nozzle 128 mounted in the righthand wall of housing 92. $CO_2$ pellets and dry compressed air are delivered to nozzle 128 by way of a solenoid valve unit 132 controlled by a foot pedal switch **132*a* located on the floor under cell 62. Once a part P has been cleaned, it may be removed from the cell by opening door 114 and placed on table 68 as shown at P' in FIG. 2**.

The top of housing 92 opens into a stainless steel hood 142 connected to a stainless duct 144 which runs along the ceiling of compartment 24 and passes through an opening 146 in partition 16 into compartment 22. In the latter compartment, the duct 144 undergoes a 90° bend and passes out of compartment 22 and container 10 as a whole through an opening 148 in the container sidewall as shown in FIG. 1.

A smaller duct 152 branches from the front of hood 142 and extends along the ceiling of compartment 24. The duct 152 extends through an opening 154 in partition 16 and then turns downward close to that partition so that it has a relatively long leg **152*a* which extends almost to the floor of compartment 22. When air is circulated into cell 62 and up through hood 142 and out through duct 144, due to the venturi effect, air from compartment 22 is drawn up through the duct 152*a*,152 and entrained in the air stream in duct 144**.

Referring to FIG. 1, as noted previously, the other container 12 contains the heavy equipment necessary to service the decontamination operation being carried out in container 10. This equipment includes a conventional $CO_2$ pellet making machine 162, an air dryer 164, and a pair of centrifugal fans 166 and 168 that circulate air through the spaces in containers 10 and 12. When the two compartments 10 and 12 are placed side-by-side as shown in FIG. 1, the duct 144 may be coupled to a duct 172 leading to the inlet of fan 166 That fan exhausts through a duct 174 which extends up through the top wall or roof of container 12, terminating in a standard exhaust vent (not shown) mounted to the top of that container. Duct 174 incorporates a bag-in/bag-out service filter section **174*a*** to accommodate filters such as standard HEPA filters, and preferably also, appropriate test ports to enable in-place testing of effluents in accordance with the intent of the ANSI/ASME N510-1980 protocols.

The other fan 168 draws in fresh air from the outside through a duct 176 leading from a vent opening 177 in the side wall of container 12. The exhaust side of fan 168 is connected to a duct 182 which extends along the ceiling in that container. Duct 182 includes a T-section **182*a* whose leg extends out through an opening 184 in the side wall of container 12. When the containers 10 and 12 are situated side-by-side as shown in FIG. 1, that opening registers with a similar opening 186 in the side wall of container 10 in compartment 24 thereof well above table 68. A louvered vent 188 may be inserted through opening 186 so that it bridges the space between the two containers and telescopes into the T-section 182*a***.

The duct 182 continues along the ceiling of container 12 and terminates in an elbow **182*b* which extends through an opening 192 in the side wall of container 12. That opening registers with a similar opening 194 in the side wall of container 10 located well above table 82 in compartment 26 of that container. When the two containers are side-by-side, a louvered vent 196 can be inserted through hole 194 and coupled to the elbow 192*b***.

When the two fans 166 and 168 are in operation, air is drawn in through the outside vent opening 177 and circulated through the duct 182 into the compartments 24 and 26 of container 10 through the vents 188 and 196 therein. Exhaust fan 166 draws the air in compartment 24 into the decontamination cell 62 through the louvers 116 in its doors 112,114 so that the interior of the test cell is maintained at a pressure which is less than that in compartments 24 and 26. Also, the exhausting air draws air from compartment 22 up through duct **152*a*,152, that compartment being vented to container 12 through mating vents 197*a* and 197*b*. Resultantly, the air pressure in compartment 22 is also maintained below that in compartments 24 and 26 which are vented to the outside by way of cracks at their doorways 36 and 46 or an appropriate vent opening (not shown) in a container. Therefore, it can be seen that in those areas where the decontamination process is being carried out, i.e. compartment 22 and decontamination cell 62**, a negative pressure is maintained which prevents airborne particles and aerosols from escaping from those spaces.

Referring to FIG. 1, the remaining components of the illustrated decontamination system are a tank of carbon dioxide gas 202 and an air compressor 204. These may be brought to the jobsite on a flatbed truck o trailer 206 and positioned alongside container 12. A flexible hose 208 leading from tank 202 is terminated by a quick-disconnect coupling 210. Coupling 210 may be connected to a mating fitting 212 mounted in the adjacent side wall of container 12. Fitting 212 is, in turn, connected by a pipe or hose 214 to the inlet of the pellet making machine 162. A pipe or hose 216 connected to the outlet of machine 162 conducts $CO_2$ pellets to the discharge nozzle in compartment 22 of container 10 and to the discharge nozzle 128 (or rather valve 132) that delivers a stream of pellets to the flexible hose 124 in decontamination cell 62. Another flexible hose 218, terminated by a quick-disconnect coupling 220, delivers air from air compressor 204 to a fitting 226 mounted in the wall of container 10. Fitting 210 is connected by a hose 228 to the inlet of air dryer 164. A hose or pipe 230 delivers compressed air from dryer 164 to nozzles 55 and 128.

Electricity to power the facility is delivered to a power panel 234 mounted to the side wall of container 12 facing trailer 206. The power panel has an external receptacle **234*a* which can receive a plug 236 at the end of a cable 240 leading from a convenient external power source. A 480 V, 400 amp service would be sufficient to power the pellet-making machine 162, air dryer 164, fans 166,168, the interior lighting and the other electrical components of the system. Wires (not shown) protectively enclosed in appropriate raceways extend along the walls and/or ceiling of container 12 to a service panel 242 mounted to the adjacent sidewall of container 10 in compartment 26 thereof, there being appropriate registering passthroughs 244*a* and 244*b*** for the wires in the opposing side walls of the two containers.

It will be seen from the foregoing that our system provides an effective facility for cleaning and decontaminating objects such as tools and parts. The components of the system can be transported to a jobsite and quickly made operative by three or even fewer people with the cleaning being carried out under controlled conditions such that there is little likelihood of contaminated material escaping from the facility.

The cleaning process itself does not use liquids of any type nor does it rely on solid grit materials or aggregates which create secondary waste problems. Rather, cleaning is preferably accomplished using solid $CO_2$ pellets propelled by dry compressed air against the objects to be cleaned. The particles shatter upon impact with the surface and flash into dry carbon dioxide gas. The flashing into a gas results in a rapid volume expansion of approximately 10 to 1 which causes the gas to penetrate into the microscopic porous surfaces of the objects and to flush out foreign materials from those pores.

The microscopic sized airborne foreign materials are captured on high efficiency particulate filters in filter section **174*a*. Larger debris lifted off the parts surfaces by the flashing carbon dioxide gas, fall to the floor of compartment 22** and may be vacuumed away by a vacuum cleaner (not shown) to the air filters using the system's ventilating air streams.

Smaller objects are cleaned in the separate decontamination cell 62 in compartment 24. The cell operator takes an object to be cleaned from a table 66 to the left of the cell and places the object on the rack or in the motorized vise inside the cell. He then directs the exit end of hose 124 at the object being cleaned. Once the object has been cleaned, it is removed and placed on the table 18 to the right of the cell. From there the cleaned object is moved through the window 70 into the compartment 26 where it may be frisked to ensure that it is free of contamination before it is released from the facility.

Once all of the required parts have been cleaned, the three parts of the system 10, 12 and 206 can be separated quite quickly and transported away from the jobsite so there is no need to permanently dedicate any ground area at the jobsite to the decontamination operation. Moreover, since the system is self-contained, there is no need to clean up the area after the facility has been taken away from the site. Finally, because the cleaning process does not involve the use of grit, chemicals and the like, there is no secondary waste to dispose of other then what is removed from the decontaminated objects and trapped by the system's clean out bags in filter section **174*a*** which can be replaced as needed.

It will thus be seen that the objects set forth above, among those made apparent from the preceding description, are efficiently attained. Also, certain changes may be made in the above construction without departing from the scope of the invention. For example, a similar facility may be used to clean chemically or biologically contaminated objects, using an appropriate cleaning process. Therefore, it is intended that all matter contained in the above description, or shown in the accompanying drawings shall be interpreted as illustrative and not in a limiting sense.

It is also to be understood that the following claims are intended to cover all of the generic and specific features of the invention herein described.

We claim:

1. A mobile decontamination system comprising a first relatively large, strong, weathertight, transportable container;

one or more partitions mounted in said first container for dividing the container into a plurality of separate compartments;

means defining doorways in each of said partitions and into said container from the outside world;

a decontamination cell in a first compartment of the first container, said cell including means providing access to the interior of said cell so that objects can be placed in the cell for cleaning, first hose means for directing a cleaning agent against objects in the cell, and at least one glove which is accessible from outside the cell and which projects into the cell so that a person in said one compartment can manipulate the objects in the cell and the first hose means to clean the objects in the cell;

means in a second compartment of the first container for testing the degree of cleanliness of the objects cleaned in the cell;

a second container similar to the first container for positioning adjacent to the first container;

means in the second container for providing a substantially dry cleaning agent;

first means for delivering said cleaning agent in a high velocity air stream from said providing means to said first hose means;

filter means in said second container;

air circulating means in the second container and connected to the outside world, and duct means extending between said first and second containers and connecting the air circulating means to said cell, said filter means and said first and second compartments so that when the air circulating means is operative, those means continuously circulate the air from said cell and said first and second compartments through the filter means while maintaining the air pressure in the cell less than the air pressures in said first and second compartments.

2. The system defined in claim 1 wherein the first and second containers are sea containers.

3. The system defined in claim 1 wherein the first container has a third compartment, and further including second hose means in said third compartment for delivering cleaning agent against objects brought into the third compartment.

second means for delivering cleaning agent from said providing means to the second hose means, and a duct section communicating with said duct means and extending into the third compartment so that when the air circulating means is operative, the air pressure in the third compartment is maintained at less than the pressures in the first and second compartments.

4. The system defined in claim 3 wherein the second and third compartments are located on opposite sides of the first compartment, and said doorway to the outside is located in said first compartment.

5. The system defined in claim 4 wherein the walls of said first and third compartments have stainless steel linings.

6. The system defined in claim 5 wherein said cleaning agent providing means comprise apparatus for making $CO_2$ pellets, and said first and second delivery means comprise first and second discharge nozzles, and compressed air means for propelling the pellets from said apparatus through said nozzles to said first and second hose means.

7. The system defined in claim 6 wherein said discharge nozzle connected to said first delivery means is mounted to said cell, and said first hose means is connected to receive the discharge from said first nozzle.

8. The system defined in claim 6 and further including a source of $CO_2$ gas;

means for conducting said gas to said pellet making apparatus;

a source of compressed air, and means for conducting compressed air from said source to said pellet making apparatus.

9. The system defined in claim 8 wherein said gas and compressed air sources are situated beside said second container.

10. The system defined in claim 1 wherein said cell comprises a generally rectangular housing having a front wall, a pair of opposite side walls and a removable tray-like bottom wall;

means for accessing the housing;

at least one glove mounted in the housing front wall and which extends into the housing and is accessible from outside the housing;

a transparent viewing window in the front wall of the housing, and a grating suspended in the housing just above the removable housing bottom wall.

11. The system defined in claim 1 and further including means connecting the interior of the second container to the duct means so that when the air circulating means is operative, the air pressure in the cell is less than the air pressure in the second container.

12. The system defined in claim 11 and further including means connecting the interior of the second container to the duct means so that when the air circulating means is operative, the air pressure in the first compartment is less than the air pressure in the second container.

13. A mobile decontamination system comprising a first relatively large, strong, weathertight transportable container;

one or more partitions mounted in said first container for dividing the container into a plurality of separate compartments;

means defining doorways in each of said partitions and into said container from the outside world;

hose means in a first one of said compartments for delivering a cleaning agent against objects brought into that compartment;

means in a second compartment of the first container for testing the degree of cleanliness of the objects cleaned in said first compartment;

a second container similar to the first container for positioning adjacent to the first container;

means in the second container for providing a substantially dry cleaning agent;

means for delivering said cleaning agent and high velocity air to said hose means in the first container;

filter means in the second container;

air circulating means in the second container and connected to the outside world, and duct means extending between the first and second containers and connecting the air circulating means to said filter means and to said first and second compartments so that when the air circulating means is operative, those means continuously circulate the air from said first and second compartments through the filter means while maintaining the air pressure in said first compartment less than the air pressure in said second compartment.

14. The system defined in claim 13 wherein said first and second containers are sea containers.

15. The system defined in claim 14 wherein the walls of said first compartment have stainless steel linings.

16. The system defined in claim 13 wherein said cleaning agent providing means comprise apparatus for making $CO_2$ pellets, and said delivery means comprise a discharge nozzle connected to said providing means and means for propelling the pellets from said apparatus through said nozzle to said hose means.

17. A mobile decontamination system comprising first and second relatively large, weathertight, transportable containers;

partitions dividing the first container into a plurality of compartments;

doorways in said partitions and into the first container from the outside;

means in the second container for producing a particulate cleaning agent capable of sublimation;

means extending between said first and second containers to deliver said cleaning agent in a high velocity air stream as an effluent to one of said compartments in said first container, said delivery means including hose means for directing the effluent against objects brought into that compartment;

filter means;

air circulating means in the second container and connected to the outside, and duct means extending between and within the first and second containers and connecting said filter means, said air circulating means and said compartments so that when the air circulating means is operative, said effluent and any debris from said object entrained therein is withdrawn from said one compartment through said filter means, with said one compartment being replenished with air from elsewhere in the first container and said second container so as to maintain the air pressure in said one compartment less than the air pressures in said second container and elsewhere in said first container.

18. The system defined in claim 17 wherein said partitions divide said first container lengthwise into a series of three compartments, a first of which is said one compartment, a second of which is adjacent to said one compartment and a third of which is adjacent to said second compartment;

a decontamination cell is located in said second compartment;

a radiation detector is located in the third compartment, and said air circulating means and said duct means distribute air to said cell and said containers so as to maintain the air pressure in said first compartment and said cell less than the air pressures in said second and third compartments and in said second container.

19. The system defined in claim 18 and further including a doorway between said third compartment and said second container.

* * * * *